United States Patent [19]

Roth et al.

[11] 4,178,012

[45] Dec. 11, 1979

[54] SKI WITH THREE-DIMENSIONAL RUNNING SURFACE

[75] Inventors: Walter Roth, Sondermoning; Hans Woitschätzke, Grünwald, both of Fed. Rep. of Germany

[73] Assignee: Trak Incorporated, Ward Hill, Mass.

[21] Appl. No.: 856,777

[22] Filed: Dec. 2, 1977

[51] Int. Cl.[2] ..... A63C 5/04

[52] U.S. Cl. ..... 280/609

[58] Field of Search ..... 280/604, 609; 9/310 A, 9/310 E; 152/209 R

[56] References Cited

U.S. PATENT DOCUMENTS

| | | | |
|---|---|---|---|
| 3,408,086 | 10/1968 | Bennett | 280/604 |
| 3,858,894 | 1/1975 | Ver et al. | 280/604 |

FOREIGN PATENT DOCUMENTS

| | | | |
|---|---|---|---|
| 2361663 | 6/1975 | Fed. Rep. of Germany | 280/604 |
| 2543712 | 4/1977 | Fed. Rep. of Germany | 280/604 |

*Primary Examiner*—Joseph F. Peters, Jr.
*Assistant Examiner*—Gene A. Church
*Attorney, Agent, or Firm*—Richard P. Crowley

[57] ABSTRACT

A three-dimensional ski base and skis having the ski base secured thereto as a running surface, the ski base comprising a plurality of scale-like protuberances inclined with respect to the bottom plane of the running surface of the ski and which rise toward the rear end of the ski, the surfaces of the protuberances convexly curved both in a longitudinal and in a transverse direction of the running surface to provide a resistance to backward movement and improved sliding properties in forward movement.

21 Claims, 12 Drawing Figures

SKI WITH THREE-DIMENSIONAL RUNNING SURFACE

BACKGROUND OF THE INVENTION

Devices for sliding or gliding over water, snow or ice, such as skis, surfboards, water skis and the like and particularly cross-country or touring skis, typically have the running surface, which is frictionally engaged with the water, snow or ice, treated or designed to reduce friction or to provide better control or stability. Treatment of cross-country skis has been accomplished by applying wax to the running surface.

The running surface of skis also has been modified structurally, particularly cross-country skis, to provide scale-like protuberances on the bottom surface of the skis. Such protuberances have been employed on one surface of a polymeric thermoplastic ski base, which base is then secured to the bottom surface of a ski. The use of three-dimensional scale formations on the running surface of a ski, to provide control and stability with respect to climbing, tracking and other ski maneuvers, has been set forth in U.S. Pat. No. 3,408,086, hereby incorporated by reference. This patent discloses the employment of rows of protuberances with curved edges along the running surface in a regular repeating pattern over the gliding surface of the ski.

U.S. Pat. No. 3,858,894, hereby incorporated by reference, is directed to an improvement of the above patent in which protuberances, particularly trapezoidal-type formations, are nonharmonically spaced to eliminate or reduce the noise level during gliding movement of the ski.

In addition, different variations of protuberances have been known for some time. Such variations have not fully satisfied the requirements of skiers as to friction, stability or control and other desirable properties (see, for example, U.S. Pat. No. 3,381,972 and German Pat. Nos. 273,954; 870,369; 1,578,922; and 1,950,327).

SUMMARY OF THE INVENTION

Our invention relates to an improved three-dimensional base having a running surface with designed protuberances thereon and to gliding devices, particularly skis, having the improved base secured to the bottom surface thereof, or to a ski with a bottom surface having a running surface with my designed protuberances.

Our invention provides a three-dimensional base useful in one embodiment as a running surface for skis in which the protuberances are designed and structured in such a manner that resistance to backward movement or sliding of the skis in use is substantially maintained as in the past, while the gliding or sliding properties of the ski or device in the forward direction is considerably and unexpectedly improved over the prior-art skis.

Our three-dimensional base is useful as a running surface for skis, and comprises protuberances which are inclined with respect to the bottom plane of the running surface and rise toward the rear end of the ski, said protuberances especially being scale-like and characterized in that the surface of said protuberances is convexly curved and crowned, particularly at the forward and side edges, in longitudinal and intransverse direction of the running surface. The curvature of said protuberances in transverse direction of the running surface may be designed preferably symmetrically or nonsymmetrically to the vertical line of said protuberances in the longitudinal direction of the running surface. The curvature in longitudinal and in transverse direction of the running surface is provided such that the boundary line of said protuberances, which faces the tip of the ski, lies in the bottom plane of the running surface of the ski.

Our improved protuberances now, so to speak, are crowned. In contrast to the protuberances known so far or used in the past, especially of the protuberances in the form of scales according to the German Pat. No. 1,578,922 or the U.S. Pat. No. 3,408,086, where the protuberances, in the longitudinal direction of the running surface and of the ski, respectively, have the profile of an inclined plane, which possibly at the end facing the rear end of the ski merges into a shoulder in the form of a horizontal plane, and, in transverse direction of the running surface and of the ski, respectively, have the profile of a straight line. Our protuberances are crowned or arcuate, in both longitudinal and transverse directions, so that the profiles represent convex curves in both transverse and in longitudinal directions.

Due to this longitudinal curvature above, all the wearing off of the surface portion facing the rear end of the ski, which is to be observed with conventional protuberances (which in longitudinal direction have the profile of an inclined plane), is avoided to a great extent as now the friction of the running surface takes place on a considerably enlarged surface area of the crowned protuberances.

In this manner, a surface profile is achieved which is particularly advantageous as regards the flow or gliding properties with respect to snow; that is, offers an extremely low resistance to motion on forward sliding. The curvature in the longitudinal direction of the sliding area is not limited to the point protruding most with respect to the bottom plane of the running surface or to the flattened (plane) zone thereof, but extends at least to the central portion (as viewed in longitudinal direction). It is also noteworthy that, when a plurality of such protuberances is arranged side-by-side in transverse direction, deeper (V-shaped) channels between the adjacent edges of these protuberances are avoided, so that snow, which otherwise would increase the resistance to motion, can hardly collect thereon, and, in fact, our crown design aids in the removal of snow from such areas. These channels or fine grooves also may be bordered by the boundary lines of further protuberances, which boundary lines face the rear end of the ski, provided that the protuberances are arranged in a plurality of rows typically offset with respect to one another.

Running surfaces with a scale pattern, as set forth in U.S. Pat. No. 3,408,086, but modified in accordance with our invention, have been tried with great success. Due to the crowned shape of the scales, the V-shaped fine grooves or channels have a considerably reduced depth in comparison to the U.S. patent depth; for example, only having a depth of 0.4 mm instead of 0.8 mm.

Of course, the depth of the protuberances may vary as desired; for example, 0.1 to 1.0 mm, but typically the depth ranges from 0.5 to 0.8 mm. The crowned nature of our protuberances, therefore, permits the depth at the fine grooves or channels where the protuberances meet to be controlled and to be considerably less than the overall depth of the protuberances from the top of the crown to the base plane of the ski-base surface. Preferably our protuberances are arranged in generally uniform and symmetrical rows across the ski width and extending longitudinally as desired over the gliding surface of the ski. The protuberances may be arranged in a series of zones, either abrupt or gradual with varying depth. For example, our protuberances may be arranged with the greatest depth of 0.6 to 0.8 mm directly under the foot of the user, and a decrease in depth; for example, 0.6 to 0.4 mm and 0.4 to 0.2 mm, toward the tip and end of the ski to a flat surface at the tip and end of the ski. The variation in depth provides better control of the ski in cross-country maneuvers.

Our base material typically is prepared by molding, embossing, extruding or otherwise forming the protuberances on a sheet material or directly onto the bottom surface of the design, such as onto one surface of an elongated flexible strip of the base material substantially the width of the ski to which the base is to be applied. In the preferred embodiment, our designed protuberances are formed on a thin, flexible, thermoplastic polymer base material which is secured, such as by lamination or other techniques, to the bottom surface of a ski or other gliding device. The ski base may be laminated to a fiber-glass supporting layer and then or simultaneously laminated to the bottom surface of a ski, alone or with the use of an adhesive, such as a curable resin like an epoxy resin. The ski base may be prelaminated to a fiber-glass layer and then the ski formed by an injection-molding technique, such as by the injection of a curable foam layer between the ski base and the ski bottom. The base material is preferably a thermoplastic, moldable or injectable plastic or polymeric material, such as composed of an olefinic resin like polyethylene, polypropylene or similar material.

In one method of manufacture, the crowned embodiment can be obtained by corresponding slight grinding of, for example, a normal running surface with scales or by corresponding pressure in the ski press of a polymeric material.

Our protuberances shall be described in connection with a preferred embodiment for skis; however, it is recognized and is a part of our invention that such protuberances may be used in connection with a variety of gliding devices and in a variety of forms and shapes.

DESCRIPTION OF THE EMBODIMENTS

Figure 6:
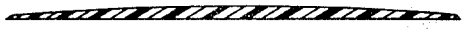
FIGS. 4–6 are cross-sectional views along the lines 4—4 to 6—6 of FIG. 2.
Figure 5:
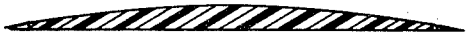
Figure 4:
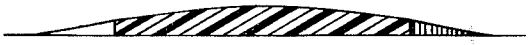
Figure 3:
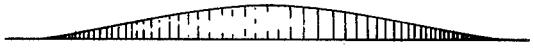
FIG. 3 is a front view of a protuberance.
Figure 1:
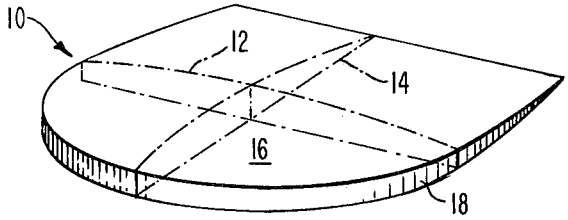
FIG. 1 is a perspective view of an individual protuberance.

FIG. 1 shows an individual, convexly contoured protuberance 10 of our invention with shaded sectional transverse 12 and longitudinal 14 plane areas to illustrate the arcuate or crowned edge 18 and surface 16. The formed edge has a depth of, for example, 0.8 mm tapering to a depth of, for example, 0.4 mm.

Figure 2:
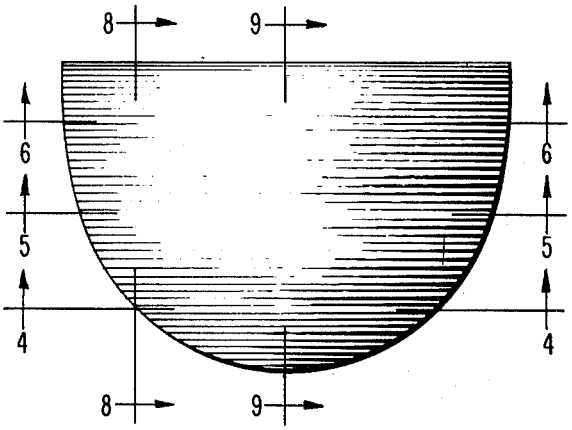
FIG. 2 is a plan view of such a protuberance showing various sectional lines in longitudinal and in transverse direction of the running surface.

FIG. 2 shows a plan view of the protuberance 10 with the crown surface 16.

FIGS. 3–6 are cross-sectional views along the respective lines 3—3, 4—4, 5—5 and 6—6 of FIG. 2, illustrating the crowned arcuate surface of the protuberance in both the transverse and longitudinal planes.

Figure 7:
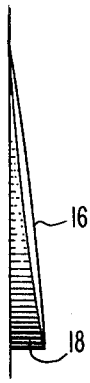
FIG. 7 is a side view of a protuberance.

FIG. 7 is a side view of the protuberance 10.

Figure 8:
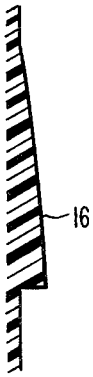
FIGS. 8 and 9 are longitudinal cross-sectional views along the lines 8—8 to 9—9 of FIG. 2.
Figure 9:
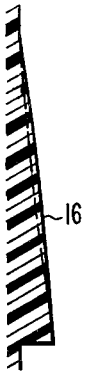

FIGS. 8 and 9 are cross-sectional views along the respective lines 8—8 and 9—9 of FIG. 2 to illustrate the crown surface 16 of the protuberance 10.

Figure 10:
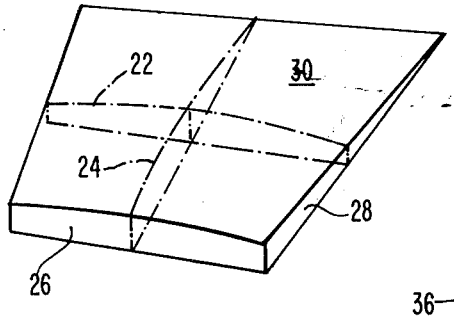
FIG. 10 shows another example of a protuberance with trapezoidal profile in perspective view.

FIG. 10 is a perspective view of a protuberance 11 with a different shape similar to that in U.S. Pat. No. 3,858,894 having a crowned surface 30, showing a transverse 22 and a longitudinal 24 plane with a raised edge 26 and a tapered side edge 28.

Figure 11:
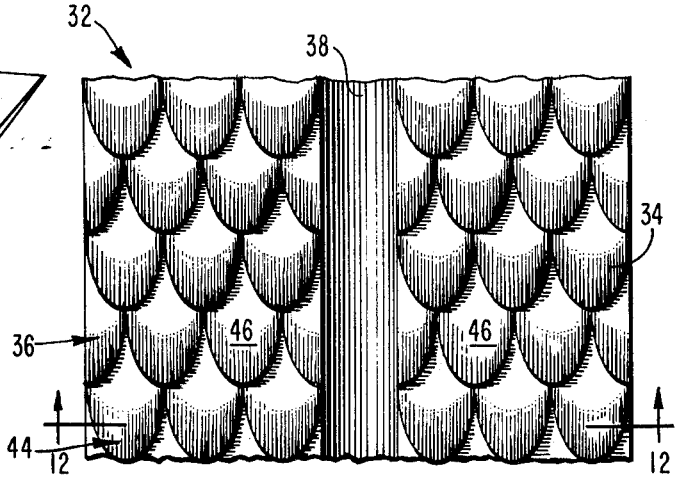
FIG. 11 shows a partial sectional bottom plan view of a running surface of a ski having the protuberances according to our invention, the protuberances arranged longitudinally in symmetrical transverse rows to a central ski-tracking groove.

FIG. 11 is a plan view of the running surface 46 of a ski 32 having an edge 34 with rows of crowned convexly curved protuberances 10 similar to FIG. 1. Ths rows 36 and 44 extend across the width of the ski and are nonsymmetrical, positioned relative to each row with the V channel of the protuberance of one row 36 placed and aligned with the apex of the convex curve of the adjacent transverse row 44 in an alternating pattern extending the length of the gliding surface of the ski. The ski has a depressed center groove 38 which may be molded or pressed into the base surface. The center groove may have protuberances therein or be free of protuberances as illustrated.

Figure 12:
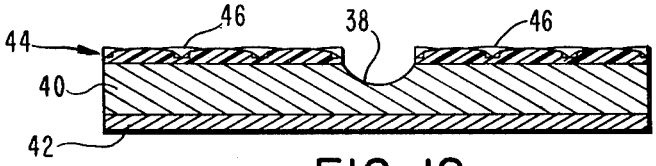
FIG. 12 is a cross-sectional view on line 12—12 of FIG. 11.

FIG. 12 is a cross-sectional view along the line 12—12 of FIG. 11, illustrating the lamination of the polymeric three-dimensional ski base to the ski 32, to provide a running surface 46 and a top ski surface 42 and an inner ski core 40 of foamed, laminated or other material.

The protuberances may be arranged as illustrated or, if desired, in a single or multiple-protuberance longitudinal row on either side of a center ski groove or the center groove omitted with the protuberances extending across all or a portion of the ski width.

The crowned protuberances may vary in shape and design and may be used alone or in a mixture with or without other crowned protuberances as desired, so that all conceivable contours of crowned protuberances in various arrangement on the gliding device are possible.

Our crowned arcuate protuberances provide increased gliding surface area while retaining the other advantages of such protuberances, and prevent the accumulation of snow in the intersecting channels or V grooves between individual protuberances. Our ski-base material and skis or gliding surfaces and devices made therefrom and in accordance with our invention thus provide an improved gliding surface.

What we claim is:

1. A gliding device particularly adapted for gliding over snow having a front end and a rear end and a three-dimensional bottom running surface, which surface comprises a plurality of protuberances which are inclined with respect to the bottom plane of the running surface and rise towards the rear end of the device to prevent backward movement of the device in use, said protuberances especially being scale-like and characterized in that the surface of said protuberances is convexly curved in both longitudinal and in transverse directions of the running surface to provide for improved forward gliding properties of the device and wherein the boundary line of said protuberances, which faces the front end of the device, lies substantially in the bottom plane of the running surface of the device.

2. The device of claim 1 wherein the curvature of said protuberances, in transverse direction of the running surface, is designed symmetrically to the vertical line of said protuberances in longitudinal direction of the running surface.

3. The device of claim 1 wherein the device is a ski.

4. The device of claim 1 wherein the protuberances are substantially similar in size and shape and the protuberances are aligned in rows transverse to the longitudinal direction of the device, with each succeeding row of protuberances being offset from the preceding row of protuberances.

5. The device of claim 1 wherein the protuberances extend in a row transverse to the longitudinal direction of the gliding device, the protuberances characterized by an arcuate shape and presenting a convexly curved edge with its curve extending toward the rear of the device.

6. The device of claim 1 wherein the protuberances extend in a row transverse to the longitudinal direction of the gliding device, the protuberances characterized by a trapezoidal shape and presenting a forward straight edge of the trapezoidal shape, representing the minor parallel base line.

7. The device of claim 1 wherein the height of the protuberances from the running surface plane to the highest point at the forward edge varies from 0.1 to 1.0 mm.

8. The device of claim 1 wherein the bottom running surface comprises a polymeric sheet material secured to the gliding device, with the protuberances formed on the one surface of the polymeric material and the protuberances extending generally over the gliding surface of the device.

9. The device of claim 5 wherein the rows of protuberances form a plurality of V shaped channels at their respective contacting boundaries of the rearward extending curve, which V channels have a height of from about 0.1 to 0.4 mm.

10. The device of claim 11 wherein the curvature of said protuberances in the transverse direction of the running surface is symmetrical to the vertical line of the protuberances in the longitudinal direction of the running surface.

11. The device of claim 1 wherein the depth of the said protuberances extending in a longitudinal direction varies with the greatest protuberance depth directly intermediate the running surface and beneath the foot of the user and with decreased protuberance depth toward the front and rear ends of the device.

12. The device of claim 1 wherein the curvature of said protuberances in the longitudinal direction of the running surface extends to the central portion of said protuberances as viewed in the longitudinal direction.

13. A snow ski having a front end and a rear end and a three-dimensional bottom running surface composed of polymeric material secured to the bottom surface of the ski, which running surface comprises a plurality of arcuate convexly curved protuberances having a forward curved edge, the protuberances inclined with respect to the bottom plane of the running surface and rising towards the rear end of the ski to prevent backward movement of the ski in use, said protuberances especially being scale-like and characterized in that the surface of said protuberances is convexly curved in longitudinal and in transverse direction of the running surface to provide for improved forward gliding properties of the ski, the protuberances aligned in rows substantially transverse to the longitudinal direction of the ski, with each succeeding row of protuberances being offset from the preceding row and wherein the boundary line of said protuberances, which faces the front end of the device, lies substantially in the bottom plane of the running surface of the ski.

14. The ski of claim 13, which ski comprises a depressed center groove extending the longitudinal direction of the ski and substantially free of protuberances.

15. The ski of claim 13 wherein the forward edges of the protuberances have a height from the running surface of from 0.1 to 1.0 mm.

16. A base sheet material adapted for use as a running surface of a ski having a front end and a rear end, which base material has one surface thereof which serves as a running surface with a plurality of protuberances which are inclined with respect to the bottom plane of the running surface and rise towards the rear end of the ski, said protuberances especially being scale-like and characterized in that the surface of said protuberances is convexly curved in longitudinal and in transverse directions of the running surface and wherein the boundary line of said protuberances, which faces the front end of the ski, lies substantially in the bottom plane of the running surface of the ski.

17. The base material of claim 16 wherein the base material is composed of a thermoplastic, hard, olefinic resin, with the protuberances formed on one surface of the base material, the protuberances varying in depth along the longitudinal direction of the running surface.

18. The base material of claim 16 wherein the material is a narrow, flexible, strip material having a width substantially as that of the ski to which the base material is to be secured, and having the protuberances aligned in rows transverse to the width of the strip, the protuberances generally arcuate in shape and forming V-type channels at the rearward boundaries of the arcuate curves, with each succeeding row of protuberances being offset from the preceding row.

19. The device of claim 1 wherein said protuberances are aligned in rows substantially transverse to the longitudinal direction of the ski, with each succeeding row also being longitudinally aligned with the preceding row.

20. The device of claim 1 wherein said protuberances are aligned in rows substantially transverse to the longitudinal direction of the ski, and wherein said aligned protuberances are separated from each other, so as to leave gaps between adjacent side edges of said protuberances.

21. The device of claim 1 wherein said bottom surface includes a longitudinal center groove.

* * * * *